US006579586B1

(12) United States Patent
Fay et al.

(10) Patent No.: US 6,579,586 B1
(45) Date of Patent: Jun. 17, 2003

(54) ENCAPSULATED INSULATION BATT ASSEMBLY

(75) Inventors: Ralph Michael Fay, Lakewood, CO (US); William D. Blalock, Highlands Ranch, CO (US)

(73) Assignee: Johns Manville International, Inc., Denver, CO (US)

( * ) Notice: Subject to any disclaimer, the term of this patent is extended or adjusted under 35 U.S.C. 154(b) by 146 days.

(21) Appl. No.: 09/672,746

(22) Filed: Sep. 28, 2000

(51) Int. Cl.[7] ..... E04B 1/88

(52) U.S. Cl. ..... 428/40.1; 52/404.1; 52/406.1; 52/406.2; 428/41.7; 428/41.8; 428/68; 428/71; 428/74; 428/76; 428/192; 428/194

(58) Field of Search ..... 428/40.1, 41.7, 428/41.8, 192, 194, 68, 71, 74, 76; 52/406.2, 406.1, 404.1, 309.11

(56) References Cited

U.S. PATENT DOCUMENTS 2,913,104 A * 11/1959 Parker ..... 206/60
3,307,306 A * 3/1967 Oliver ..... 52/173
3,729,879 A * 5/1973 Franklin ..... 52/173
4,709,523 A * 12/1987 Broderick ..... 52/406

* cited by examiner

*Primary Examiner*—Nasser Ahmad
(74) *Attorney, Agent, or Firm*—Robert D. Touslee

(57) ABSTRACT

A fibrous insulation batt is encapsulated within an envelope to form an encapsulated insulation batt assembly. The envelope has pressure sensitive adhesive on lateral flanges or surfaces of the envelope for securing the encapsulated insulation batt assembly to spaced-apart frame members defining a cavity to be insulated. Release liners, on surfaces of the envelope or the lateral flanges, which overlay and are releasably secured to the pressure sensitive adhesive, are removed from the pressure sensitive adhesive immediately prior to bonding the encapsulated insulation batt assembly to the spaced-apart frame members. Preferably, the release liners for the pressure sensitive adhesive are contact areas on the surfaces of the envelope or the lateral flanges coated or otherwise treated with a release agent.

44 Claims, 4 Drawing Sheets

3/4

ENCAPSULATED INSULATION BATT ASSEMBLY

BACKGROUND OF THE INVENTION

The present invention relates to an encapsulated insulation batt assembly, and, in particular, to an encapsulated insulation batt assembly wherein the envelope encapsulating the insulation batt is provided with a pressure sensitive adhesive on its surface or flanges for bonding the encapsulated insulation batt assembly to spaced-apart framing members defining a cavity to be insulated.

Encapsulated insulation batt assemblies are used to insulate building cavities having widths defined by spaced-apart framing members of the building, such as but not limited to, wall studs, floor and ceiling joists, and rafters. The insulation batts used in these encapsulated insulation batt assemblies are resilient glass fiber insulation batts or insulation batts made of other resilient fibrous materials. Typically, these encapsulated insulation batt assemblies are held in place by stapling or taping lateral flanges of the encapsulated insulation batt assemblies to the framing members or the insulation batts used in these encapsulated insulation batt assemblies are made with a higher density and greater width, than would otherwise be required, to enable the encapsulated insulation batt assemblies to be "press fit" between the framing members defining the cavities being insulated.

When the "press fit" method of installation is used, the densities of these insulation batts can be up to 40% greater than otherwise required for insulating purposes and the width of these batts is greater than the standard spacing between successive or adjacent framing members rather than about equal to or less than the standard spacing between successive adjacent framing members. The greater density of the insulation batts used in these encapsulated insulation batt assemblies provides the encapsulated insulation batt assemblies with greater resilience and the greater width of the insulation batts used in these insulation batt assemblies enables the encapsulated insulation batt assemblies to be wedged or press fit between adjacent framing members to hold the encapsulated insulation batt assemblies in place. However, while eliminating the need for stapling or taping the encapsulated insulation batt assemblies in place, wedging or press fitting the encapsulated insulation batt assemblies between successive or adjacent framing members to hold the encapsulated insulation batt assemblies in place has several disadvantages. The full benefit of the vapor barrier to be formed with the installation of the encapsulated insulation batt assemblies can be lost when the lateral flanges of these encapsulated insulation batt assemblies end up being shoved into the cavities rather than extending out and covering the exposed surfaces of the adjacent framing members defining the sides of the cavity. In addition, the increased density and the increased width of the insulation batts used in the encapsulated insulation batt assemblies increases material costs.

SUMMARY OF THE INVENTION

The encapsulated insulation batt assembly of the present invention provides a solution to the above discussed problems by providing an encapsulated insulation batt assembly that is easy to install, without the need to staple or tape the encapsulated insulation batt assembly in place, and that can maintain vapor barrier integrity by bonding certain surfaces or lateral flanges of the envelope of the encapsulated insulation batt assembly to the framing members defining the sides of the cavity being insulated. In addition, the encapsulated insulation batt assembly of the present invention saves on material costs by requiring no increase in the density of the insulation batt used in the encapsulated insulation batt assembly to increase the resilience of the insulation batt for installation purposes and by, preferably, using an insulation batt having a width about equal to or slightly less than the width of the cavity to be insulated.

The encapsulated insulation batt assembly of the present invention includes a fibrous insulation batt or blanket (hereinafter referred to as a "batt"), preferably, having a width substantially equal to the width of a cavity being insulated with the encapsulated insulation batt assembly; first and second major surfaces defined by the width and the length of the insulation batt; lateral surfaces defined by the length and the thickness of the insulation batt; and end surfaces defined by the width and the thickness of the insulation batt. The insulation batt is encapsulated or contained within an envelope, e.g. a polymeric film envelope, having first and second major surfaces, lateral surfaces and end surfaces overlaying the first and second major surfaces, the lateral surfaces and the end surfaces of the insulation batt.

The envelope has lateral flanges which extend for the length of the insulation batt. In several embodiments of the present invention, one side of each of the lateral flanges has a pressure sensitive adhesive thereon for securing the lateral flanges of the envelope to spaced-apart frame members defining the cavity being insulated. In these different embodiments of the assembly, the lateral flanges are located: a) adjacent the lateral edges of a first major surface of envelope; b) on lateral surfaces of the envelope intermediate the lateral edges of the major surfaces of the envelope; and c) with one lateral flange adjacent one lateral edge of the envelope and the other lateral flange on the same major surface of the envelope and adjacent but spaced inwardly from the second lateral edge of that major surface of the envelope. These lateral flanges can be extended outward from the surfaces of the envelope for securing the encapsulated insulation batt assembly to spaced-apart frame members defining the cavity being insulated with the pressure sensitive adhesive on the flanges.

These embodiments of the encapsulated insulation batt assembly also include a release liner for the pressure sensitive adhesive on each of the lateral flanges which overlays and is releasably secured to the pressure sensitive adhesive on the lateral flange. The release liners cover the pressure sensitive adhesive prior to installation of the encapsulated insulation batt assembly and are removed from the pressure sensitive adhesive immediately prior to bonding the lateral flanges of the encapsulated insulation batt assembly to the spaced-apart frame members defining the cavity being insulated.

While the release liners for the pressure sensitive adhesive on the lateral flanges can be separate release liner strips, preferably, the release liners for the pressure sensitive adhesive on the lateral flanges of the envelope are contact areas on the surface of the envelope that have been treated with a release agent. The lateral flanges of the envelope can each be folded from a first position where the lateral flanges extend generally parallel to and are releasably bonded by the pressure sensitive adhesive to the contact areas on the surfaces of the envelope for pre-installation handling of the encapsulated insulation batt assembly to a second position where the lateral flanges extend outward, away from the contact areas on the surfaces of the envelope, for installation of the encapsulated insulation batt assembly. Prior to the installation of the encapsulated insulation batt assembly, the lateral flanges of the envelope are located in the first position with the pressure sensitive adhesive on the lateral flanges in contact with and releasably bonded to the contact areas on the surfaces of the envelope.

In another embodiment of the encapsulated insulation batt assembly of the present invention, a first lateral flange is located on the envelope adjacent a first lateral edge of a first major surface of the envelope and a second lateral flange is located on the envelope adjacent a second lateral edge of a second major surface of the envelope. Surfaces of these lateral flanges are treated or coated with a release agent or have a release agent strip bonded thereto and overlay contact areas on the surfaces of the envelope coated with a pressure sensitive adhesive. When the encapsulated insulation batt assembly is to be installed, the lateral flanges are peeled back from the pressure sensitive adhesive and the contact areas on the surfaces of the envelope with the pressure sensitive adhesive thereon are pressed against framing members to secure the encapsulated insulation batt assembly in place.

DESCRIPTION OF THE PREFERRED EMBODIMENTS

Figure 1:
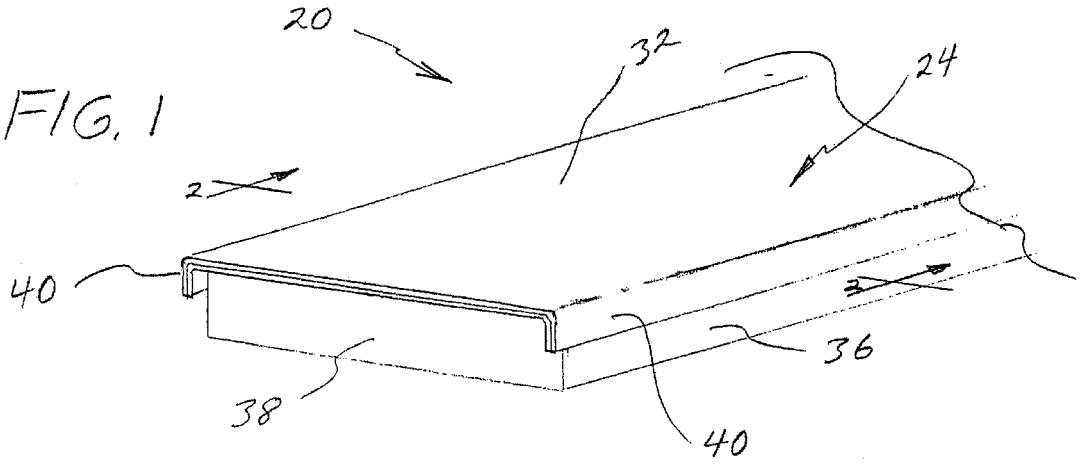
FIG. 1 is a partial schematic perspective view of a first embodiment of the encapsulated insulation batt assembly of the present invention.
Figure 2:
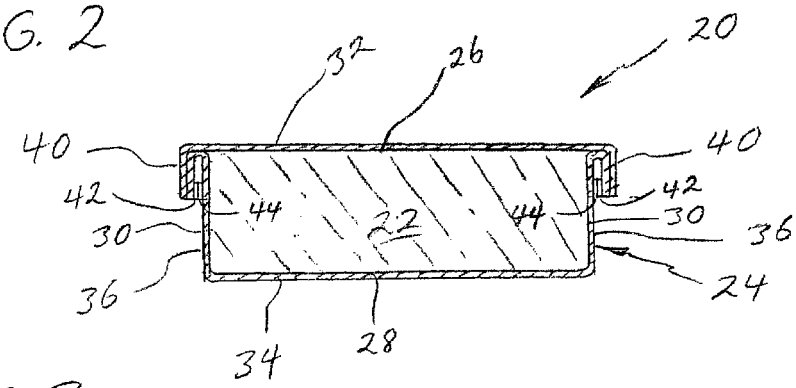
FIG. 2 is a schematic transverse cross section of the encapsulated insulation batt assembly of FIG. 1, taken substantially along lines 2—2 of FIG. 1.
Figure 3:
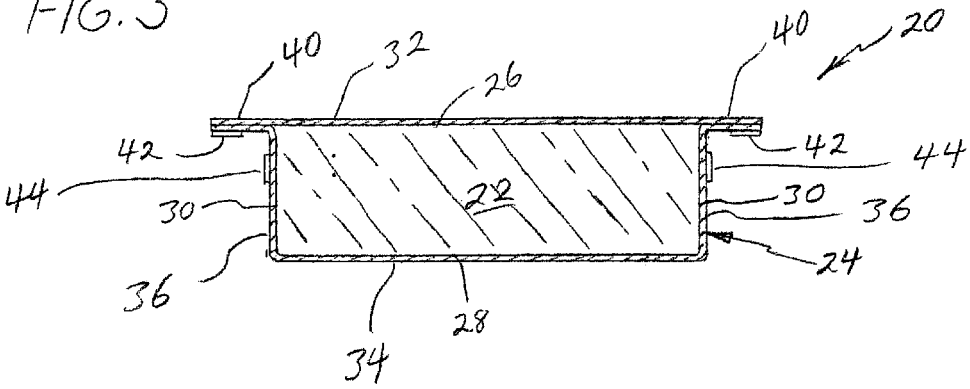
FIG. 3 is a schematic transverse cross section of the encapsulated insulation batt assembly of FIG. 1, after the lateral flanges of the envelope have been extended outward away from the lateral surfaces of the envelope.

As shown in FIGS. 1 to 3, a first embodiment 20 of the encapsulated insulation batt assembly of the present invention includes a fibrous insulation batt 22 and an envelope 24 containing or encapsulating the fibrous insulation batt. When the ends of the encapsulated insulation batt assembly 20 are enclosed, the encapsulated insulation batt assembly is typically vented, e.g. with holes in the ends of the envelope, to permit air to flow out of the encapsulated insulation batt assembly when the assembly is compressed for packaging and shipment and into the encapsulated insulation batt assembly when the assembly is removed from the package for installation. Preferably, the fibrous insulation batt 22 is made of a compressible, resilient fibrous insulation material, such as but not limited to a batt of glass fiber insulation. Preferably, the fibrous insulation batt 22 has a width substantially equal to or slightly less the width of a cavity being insulated with the encapsulated insulation batt assembly. For example, for standard cavity widths used in the building industry where the 2×4, 2×6, 2×10 wooden framing members, metal framing members, or other framing members are located on sixteen or twenty four inch centers, the widths of the insulation batts 22 utilized in the encapsulated insulation batt assemblies 20 would preferably be about fourteen and one half to about fifteen inches or about twenty two and one half to about twenty three inches in width. The insulation batts 22 have first and second major surfaces 26 and 28 defined by the width and the length of the insulation batt; lateral surfaces 30 defined by the length and the thickness of the insulation batt; and end surfaces (not shown) defined by the width and the thickness of the insulation batt.

The insulation batt 22 is encapsulated or contained within the envelope 24 which has first and second major surfaces 32 and 34, lateral surfaces 36, and, typically, end surfaces 38 overlaying the first and second major surfaces, the lateral surfaces and the end surfaces of the insulation batt. Preferably, the envelope 24 is a polymeric film envelope, such as but not limited to, a polyolefin film (e.g. a polypropylene and polyethylene film) or a polyester film (e.g. a PET film) having a thickness from about 0.25 mils to about 2.0 mils. However, the envelope 24 may also be made from or include other materials such as kraft paper, polymeric nonwoven scrim or other facing materials used separately or in combination with each other and/or the polymeric film. An example of such an envelope would be an envelope with an asphalt coated kraft facing overlaying one major surface of the insulation batt and a scrim material encapsulating the lateral surfaces and the second major surface insulation batt. Another example of such an envelope would be an envelope with a polymeric film facing overlaying one major surface of the insulation batt and a scrim material encapsulating the lateral surfaces and the second major surface of the insulation batt. An example of a suitable kraft paper for the envelope is a 30–40 pound/3000 $ft^2$ kraft paper and an example of a polymeric nonwoven scrim for the envelope is a 0.5–1.5 ounce/$yd^3$ Reemay. While for many applications it is preferred that the envelope be a moisture vapor barrier, the envelope may be permeable to water vapor.

The envelope 24 of FIGS. 1–3 has lateral flanges 40 which, preferably, are located adjacent the first major surface 32 of the envelope and extend for at least the length of the insulation batt 22 within the envelope. The lateral flanges 40 of the envelope 24 each have first and second sides. The second side of each of the lateral flanges 40 has a pressure sensitive adhesive 42 thereon for securing each of the lateral flanges 40 of the envelope 24 to spaced-apart frame members defining the cavity being insulated. The encapsulated insulation assembly 20 also includes release liners 44 for the pressure sensitive adhesive 42 on each of the lateral flanges 40 which overlay and are releasably secured to the pressure sensitive adhesive 42 on the lateral flanges. The release liners 44 cover the pressure sensitive adhesive 42 prior to installation of the encapsulated insulation batt assembly 20 and are removed from the pressure sensitive adhesive 42 immediately prior to bonding the lateral flanges 40 of the encapsulated insulation batt assembly to the spaced-apart frame members defining the cavity being insulated.

Preferably, the release liners 44 for the pressure sensitive adhesive 42 on each of the lateral flanges 40 of the envelope are pressure sensitive adhesive contact areas on the lateral surfaces 36 of the envelope (areas on the lateral surfaces 36 of the envelope 24 that will be contacted by the pressure sensitive adhesive 42 on the lateral flanges 40 when the lateral flanges are positioned against the lateral surfaces of the envelope) that have been treated or coated with silicone or some other conventional, commercially available, release agent. The lateral flanges 40 of the envelope 24 can each be folded from a first position where the lateral flanges 40 extend generally parallel to the lateral surfaces 36 of the envelope for pre-installation handling of the encapsulated insulation batt assembly 20 to a second position where the lateral flanges 40 extend outward away from the lateral surfaces of the envelope 24 for installation of the encapsulated insulation batt assembly 20. Prior to the installation of the encapsulated insulation batt assembly 20, the lateral flanges 40 of the envelope 24 are located in the first position with the pressure sensitive adhesive 42 on the second surfaces of the lateral flanges 40 in contact with and releasably bonded to the contact areas 44 of the lateral surfaces 36 of the envelope 24. While it is contemplated that separate release liners (e.g. separate sheets or strips of paper coated on one surface with a release agent such as silicone) could be used instead of utilizing the release agent coated or treated contact areas on the lateral surfaces 36 of the envelope 24 as the release liners 44, the use of the coated contact areas on the lateral surfaces of the envelope is preferred because the release liners 44 remain integral with, the installed encapsulated insulation batt assembly 20 and thereby eliminate the disposal problems and added material costs associated with separate release liners.

The pressure sensitive adhesive 42 may be applied to the second surfaces of the lateral flanges 40 as a double stick tape coated with the pressure sensitive adhesive, a sprayed web of the pressure sensitive adhesive, dots of the pressure sensitive adhesive, beads of the pressure sensitive adhesive, or a coating of the pressure sensitive adhesive applied by other conventional methods. The second surfaces of the lateral flanges 40, which are typically about ¾ of an inch to about 1 inch in width, need not be completely covered with the pressure sensitive adhesive 42 and, preferably, the pressure sensitive adhesive 42 only covers from about 20% to about 50% of the surface areas of the second surfaces of the lateral flanges 40.

Figure 11:
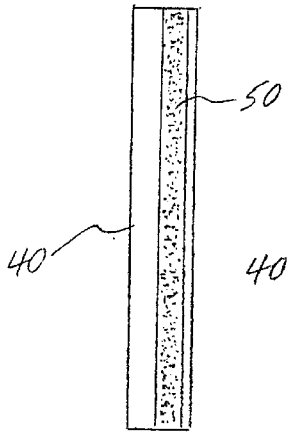
FIGS. 11 to 14 schematically depict various pressure sensitive adhesive patterns which may be used on the lateral flanges and contact areas of the envelope of the encapsulated insulation batt assemblies of the present invention.
Figure 12:
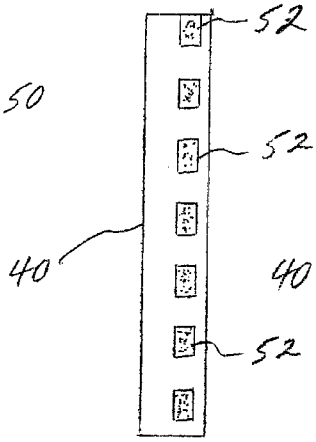
Figure 13:
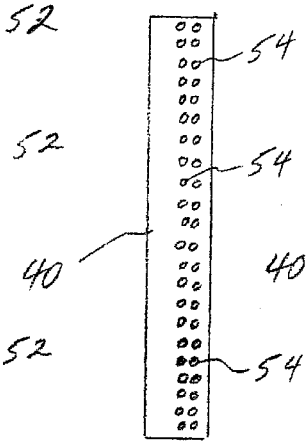
Figure 14:
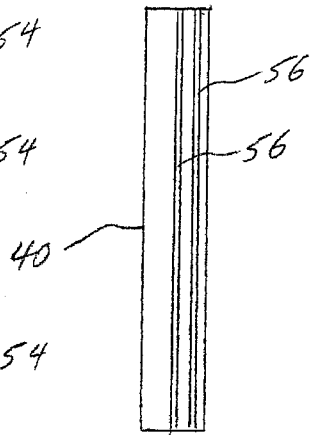

FIG. 11 schematically shows the pressure sensitive adhesive 42 applied to the second surface of a lateral flange 40 as a continuous strip 50, e.g. a continuous strip of double stick tape, a continuous web strip, or a continuous coating strip. FIG. 12 schematically shows the pressure sensitive adhesive 42 applied to the second surface of a lateral flange 40 as a discontinuous strip 52, e.g. a discontinuous strip of double stick tape, a discontinuous web strip, or a discontinuous coating strip. FIG. 13 schematically shows the pressure sensitive adhesive 42 applied to the second surface of a lateral flange 40 as a plurality of dots 54 extending along the length of the lateral flange 40. FIG. 14 schematically shows the pressure sensitive adhesive 42 applied to the second surface of a lateral flange 40 as a plurality of beads 56 extending along the length of the lateral flange 40.

Preferably, the pressure sensitive adhesive 42 is selected to provide a long shelf life with little or no creep or degradation during limited exposures to temperatures of up to 145° F. so that packages of the encapsulated insulation batt assembly 20 are ready for use even after sitting in a warehouse for months or being exposed to elevated temperatures during transit. The pressure sensitive adhesive is also selected to function well when installed at the job site at temperatures between about 40° F. and about 100° F. In addition, the pressure sensitive adhesive selected: should permit the lateral flanges 40 to be easily pulled away from the release liners 44 when the encapsulated insulation batt assembly is being installed; provide good adhesion to both wood and metal frame members, such as metal studs that are covered with dust, machine oil or other contaminates typically found on metal studs at a job site; and enable the lateral flanges 40 to be repositioned, if necessary, when securing or bonding the lateral flanges to the frame members to obtain the best fit. Examples of pressure sensitive adhesives 42 that adhere well to both wood and metal surfaces are double stick tapes sold under the trade designation "COMPAC 251" AND "COMPAC 351" by Compac Industries, Inc. of Edison, N.J. Another example of pressure sensitive adhesives which work well are hot melt pressure sensitive adhesives sold by ATO Findley Inc. of Wauwatosa, Wis. The components of the pressure sensitive adhesive system used on the encapsulated insulation batt assemblies 20 may also include fire retardant additives or use fire retardant polymers. The double stick tapes sold under the trade designations "COMPAC 251" AND "COMPAC 351" by Compac Industries, Inc. of Edison, N.J. are examples of pressure sensitive adhesive systems with fire retardant properties.

Figure 4:
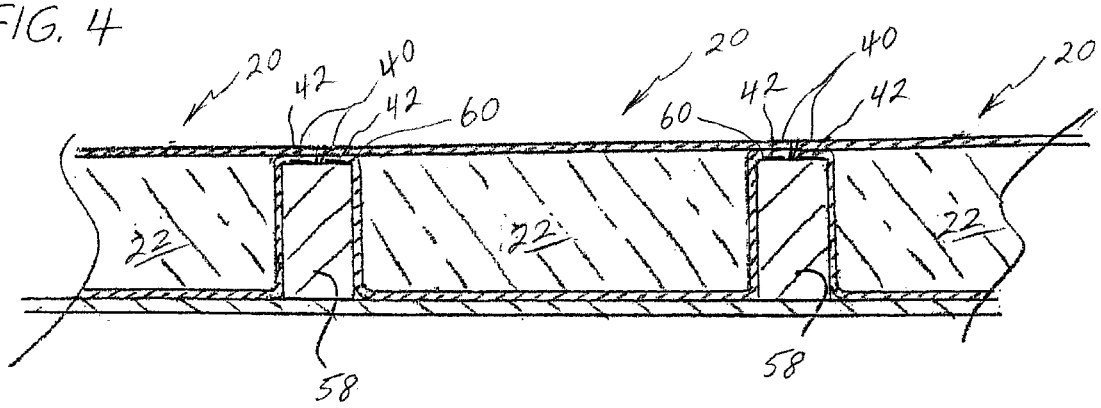
FIG. 4 is a schematic horizontal cross section through a wall illustrating the installation of the encapsulated insulation batt assembly of FIG. 1 in a wall.

As shown in FIG. 4, the encapsulated insulation batt assemblies 20 of the present invention are typically installed between the adjacent or successive spaced-apart frame members 58 of a building, such as but not limited to wall studs, floor and ceiling joists, and rafters. The lateral flanges 40 of the envelopes 24 overlay the still exposed surfaces 60 of the frame members and are bonded to the exposed surfaces 60 of the frame members by the pressure sensitive adhesive 42 before the drywall or other interior wall panels (not shown) are secured to the frame members 58.

Figure 5:
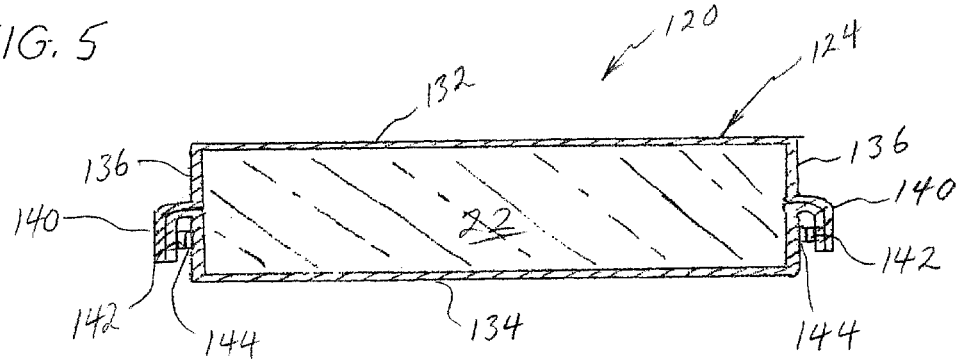
FIG. 5 is a schematic transverse cross section of a second embodiment of the encapsulated insulation batt assembly of the present invention.

As shown in FIG. 5, a second embodiment 120 of the encapsulated insulation batt assembly of the present invention includes a fibrous insulation batt 22 and an envelope 124 containing or encapsulating the fibrous insulation batt. The fibrous insulation batt 22 is the same as the fibrous insulation batt described in connection with the first embodiment 20 of the encapsulated insulation batt assembly.

The insulation batt 22 is encapsulated or contained within the envelope 124 which has first and second major surfaces 132 and 134, lateral surfaces 136, and, typically, end surfaces (not shown) overlaying the first and second major surfaces, the lateral surfaces and the end surfaces of the insulation batt. The envelope 124 is made of the same materials described in connection with the envelope 24 of the first embodiment 20 of the encapsulated insulation batt assembly.

The envelope 124 of FIG. 5 has lateral flanges 140 which extend from the lateral surfaces 136 of the envelope 124 intermediate rather than at or adjacent lateral edges of the major surfaces 132 and 134 of the envelope. The lateral flanges 140 extend for at least the length of the insulation batt 22 within the envelope. The lateral flanges 140 of the envelope 124 each have first and second sides. The second side of each of the lateral flanges 140 has a pressure sensitive adhesive 142 thereon for securing the lateral flanges 140 of the envelope 124 to spaced-apart frame members defining the cavity being insulated. The encapsulated insulation assembly 120 also includes release liners 144 for the pressure sensitive adhesive 142 on each of the lateral flanges 140 which overlay and are releasably secured to the pressure sensitive adhesive 142 on the lateral flanges. The release liners 144 cover the pressure sensitive adhesive 142 prior to installation of the encapsulated insulation batt assembly 120 and are removed from the pressure sensitive adhesive 142 immediately prior to bonding the lateral flanges 140 of the encapsulated insulation batt assembly to the spaced-apart frame members defining the cavity being insulated.

Preferably, the release liners 144 for the pressure sensitive adhesive 142 on each of the lateral flanges 140 of the envelope are pressure sensitive adhesive contact areas on the lateral surfaces 136 of the envelope (areas on the lateral surfaces 136 of the envelope 124 that will be contacted by the pressure sensitive adhesive 142 on the lateral flanges 140 when the flanges are positioned against the lateral surfaces of the envelope) that have been treated or coated with silicone or some other conventional, commercially available, release agent. The lateral flanges 140 of the envelope 124 can each be folded from a first position where the lateral flanges 140 extend generally parallel to the lateral surfaces 136 of the envelope for pre-installation handling of the encapsulated insulation batt assembly to a second position where the lateral flanges 140 extend outward, away from the lateral surfaces of the envelope 124, for installation of the encapsulated insulation batt assembly 120. Prior to the installation of the encapsulated insulation batt assembly 120, the lateral flanges 140 of the envelope 124 are located in the first position with the pressure sensitive adhesive 142 on the second surfaces of the lateral flanges 140 in contact with and releasably bonded to the contact areas 144 of the lateral surfaces 136 of the envelope 124. While it is contemplated that separate release liners (e.g. separate sheets or strips of paper coated on one surface with a release agent such as silicone) could be used instead of utilizing the coated or treated contact areas on the lateral surfaces 136 of the envelope 124 as the release liners 144, the use of the coated contact areas on the lateral surfaces of the envelope is preferred because the release liners 144 remain integral with the installed encapsulated insulation batt assembly and thereby eliminate the disposal problems and added material costs associated with separate release liners.

As with the first embodiment 20, the pressure sensitive adhesive 142 may be applied to the second surfaces of the lateral flanges 140 as a double stick tape coated with the pressure sensitive adhesive, a sprayed web of the pressure sensitive adhesive, dots of the pressure sensitive adhesive, beads of the pressure sensitive adhesive, or a coating of the pressure sensitive adhesive applied by other conventional methods. The second surfaces of the lateral flanges 140, which are typically about ¾ of an inch to about 1 inch in width, need not be completely covered with the pressure sensitive adhesive 142 and, preferably, the pressure sensitive adhesive 142 only covers from about 20% to about 50% of the surface areas of the second surfaces of the lateral flanges 140. The pressure sensitive adhesive 142 is the same as that described in connection with the first embodiment 20 of the encapsulated insulation batt and may be applied to the lateral flanges 140 in the same manner as shown in the examples of FIGS. 11 to 14.

Figure 6:
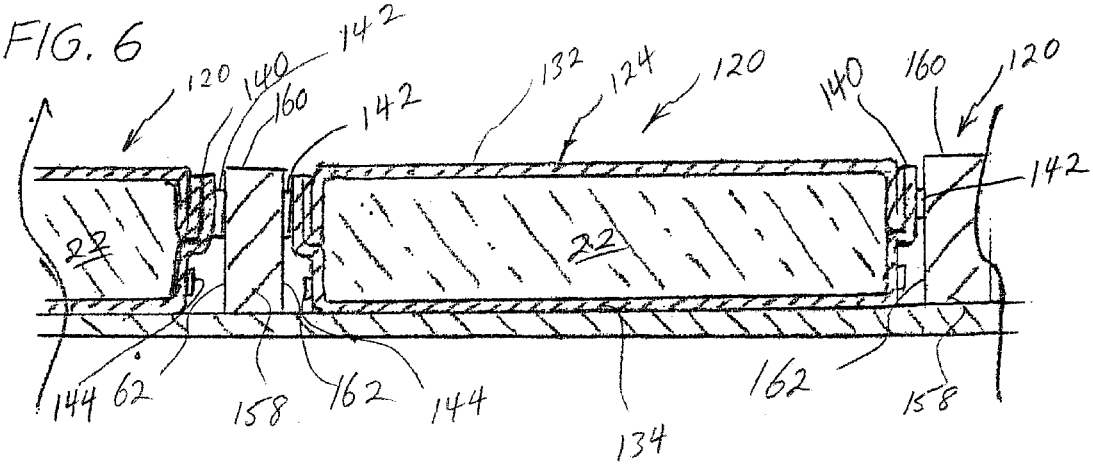
FIG. 6 is a schematic horizontal cross section through a wall illustrating the installation of the encapsulated insulation batt assembly of FIG. 5 in a wall.

As shown in FIG. 6, the encapsulated insulation batt assemblies 120 of the present invention are typically installed between the adjacent or successive spaced-apart frame members 158 of a building, such as but not limited to, wall studs, floor and ceiling joists, and rafters. The lateral flanges 140 of the envelopes 124 overlay the still exposed side surfaces 162 of the frame members rather than the surfaces 160 and are bonded to the exposed surfaces 162 of the frame members by the pressure sensitive adhesive 142 before the drywall or other interior wall panels (not shown) are secured to the frame members 158.

Figure 7:
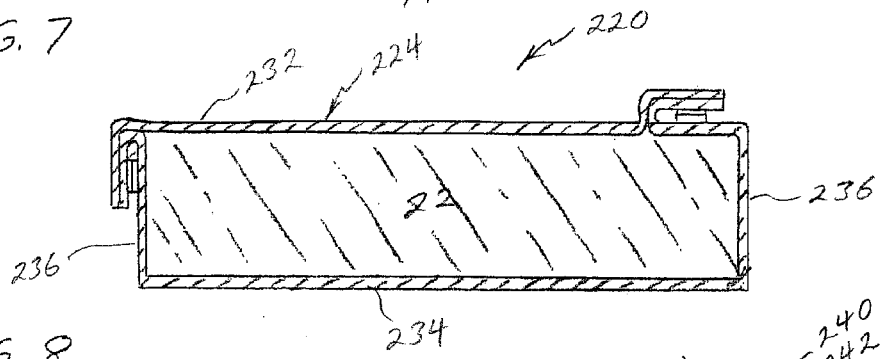
FIG. 7 is a schematic transverse cross section of a third embodiment of the encapsulated insulation batt assembly of the present invention.

FIG. 7 shows a third embodiment 220 of the encapsulated insulation batt assembly of the present invention which is normally used with channel or U-shaped metal frame members and includes a fibrous insulation batt 22 and an envelope 224 containing or encapsulating the fibrous insulation batt. The fibrous insulation batt 22 is the same as the fibrous insulation batt described in connection with the first embodiment 20 of the encapsulated insulation batt assembly.

The insulation batt 22 is encapsulated or contained within the envelope 224 which has first and second major surfaces 232 and 234, lateral surfaces 236, and, typically, end surfaces (not shown) overlaying the first and second major surfaces, the lateral surfaces and the end surfaces of the insulation batt. The envelope 224 is made of the same materials described in connection with the envelope 24 of the first embodiment 20 of the encapsulated insulation batt assembly.

The envelope 224 of FIG. 7 has a first lateral flange 240 which extends from adjacent a first lateral edge of the major surface 232 of the envelope and a second lateral flange 241 which extends toward a second lateral edge of the major surface 232 of the envelope from a location adjacent but spaced inwardly from the second lateral edge of the major surface 232 of the envelope. Preferably, the spacing, from the second lateral edge of the envelope, of the location from which the lateral flange 241 extends from the major surface 232 of the envelope 224 is about equal to the depth of the channel of a standard channel shaped metal framing member used in the industry, e.g. about 1½ to about 2 inches. The lateral flanges 240 and 241 extend for at least the length of the insulation batt 22 within the envelope. The lateral flanges 240 and 241 of the envelope 224 each have first and second sides. The second sides of the lateral flanges 240 and 241 have a pressure sensitive adhesive 242 thereon for securing the lateral flanges 240 and 241 of the envelope 224 to spaced-apart frame members defining the cavity being insulated. The encapsulated insulation assembly 220 also includes release liners 244 for the pressure sensitive adhesive 242 on the lateral flanges 240 and 241 which overlay and are releasably secured to the pressure sensitive adhesive 242 on the lateral flanges. The release liners 244 cover the pressure sensitive adhesive 242 prior to installation of the encapsulated insulation batt assembly 220 and are removed from the pressure sensitive adhesive 242 immediately prior to bonding the lateral flanges 240 and 242 of the encapsulated insulation batt assembly to the spaced-apart frame members defining the cavity being insulated.

Preferably, the release liners 244 for the pressure sensitive adhesive 242 on the lateral flanges 240 and 242 of the envelope are pressure sensitive adhesive contact areas on the surface of the envelope (areas on the surface of the envelope 224 that will be contacted by the pressure sensitive adhesive 242 on the lateral flanges 240 and 241 when the lateral flanges are positioned against the surface of the envelope) that have been treated or coated with silicone or some other conventional, commercially available, release agent. The lateral flange 240 of the envelope 224 can be folded from a first position where the lateral flange 240 extends from adjacent the first lateral edge of the major surface 232 of the envelope generally parallel to and in contact with the release liner 244 on the lateral surface 236 of the envelope for pre-installation handling of the encapsulated insulation batt assembly to a second position where the lateral flange 240 extends outward, away from the lateral surface of the envelope 224, for installation of the encapsulated insulation batt assembly 220. The lateral flange 241 of the envelope 224 can be folded from a first position where the lateral flange 241 extends toward the second lateral edge of the major surface 232 of the envelope generally parallel to and in contact with the release liner 244 on the major surface 232 of the envelope for pre-installation handling of the encapsulated insulation batt assembly to a second position where the lateral flange 241 extends outward, away from the major surface of the envelope 224, for installation of the encapsulated insulation batt assembly 220. Prior to the installation of the encapsulated insulation batt assembly 220, the lateral flanges 240 and 241 of the envelope 224 are located in the first position with the pressure sensitive adhesive 242 on the second surfaces of the lateral flanges 240 and 241 in contact with and releasably bonded to the contact areas 244 on the surface of the envelope 224. While it is contemplated that separate release liners (e.g. separate sheets or strips of paper coated on one surface with a release agent such as silicone) could be used instead of utilizing the release agent coated or treated contact areas on the surface of the envelope 224 as the release liners 244, the use of the coated contact areas on the surfaces of the envelope is preferred because the release liners 244 remain integral with the installed encapsulated insulation batt assembly and thereby eliminate the disposal problems and added material costs associated with separate release liners.

As with the first embodiment 20, the pressure sensitive adhesive 242 may be applied to the second surfaces of the lateral flanges 240 and 241 as a double stick tape coated with the pressure sensitive adhesive, a sprayed web of the pressure sensitive adhesive, dots of the pressure sensitive adhesive, beads of the pressure sensitive adhesive, or a coating of the pressure sensitive adhesive applied by other conventional methods. The second surfaces of the lateral flanges 240 and 241, which are typically about ¾ of an inch to about 1 inch in width, need not be completely covered with the pressure sensitive adhesive 242 and, preferably, the pressure sensitive adhesive 242 only covers from about 20% to about 50% of the surface areas of the second surfaces of the lateral flanges 240 and 241. The pressure sensitive adhesive 242 is the same as that described in connection with the first embodiment 20 of the encapsulated insulation batt and may be applied to the flanges 240 in the same manner as shown in the examples of FIGS. 11 to 14.

Figure 8:
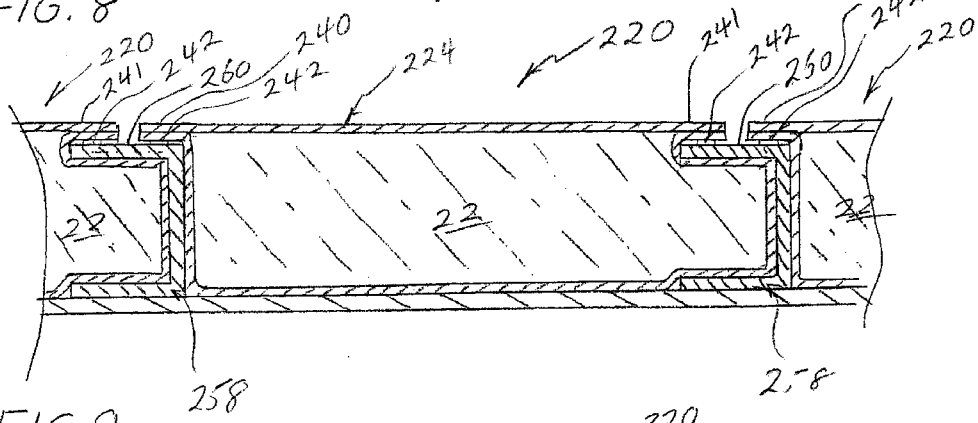
FIG. 8 is a schematic horizontal cross section through a wall illustrating the installation of the encapsulated insulation batt assembly of FIG. 7 in a wall.

As shown in FIG. 8, the encapsulated insulation batt assemblies 220 of the present invention are typically installed between the adjacent or successive spaced-apart channel shaped frame members 258 of a building, such as but not limited to, wall studs, floor and ceiling joists, and rafters. The lateral flanges 240 and 241 of the envelopes 224 overlay the still exposed surfaces 260 of the frame members and are bonded to the exposed surfaces 260 of the frame members by the pressure sensitive adhesive 242 before the drywall or other interior wall panels (not shown) are secured to the frame members 258. However, with the location of the lateral flange 241 on each of the envelopes 224 (extending toward the second lateral edge of the envelope from a location adjacent but spaced inwardly from the second lateral edge of the envelope), a lateral portion of each of the encapsulated insulation batt assemblies 220 is received within the channel of a frame member 258 to better insulate the cavities formed by the succeeding frame members 258.

Figure 9:
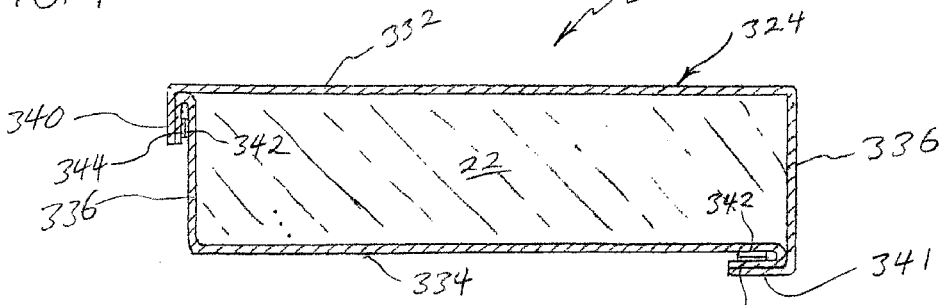
FIG. 9 is a schematic transverse cross section of a fourth embodiment of the encapsulated insulation batt assembly of the present invention.

FIG. 9 shows a fourth embodiment 320 of the encapsulated insulation batt assembly of the present invention which is normally used with channel or U-shaped metal frame members and includes a fibrous insulation batt 22 and an envelope 324 containing or encapsulating the, fibrous insulation batt. The fibrous insulation batt 22 is the same as the fibrous insulation batt described in connection with the first embodiment 20 of the encapsulated insulation batt assembly.

The insulation batt 22 is encapsulated or contained within the envelope 324 which has first and second major surfaces 332 and 334, lateral surfaces 336, and, typically, end surfaces (not shown) overlaying the first and second major surfaces, the lateral surfaces and the end surfaces of the insulation batt. The envelope 324 is made of the same materials described in connection with the envelope 24 of the first embodiment 20 of the encapsulated insulation batt assembly.

The envelope 324 of FIG. 9 has a first lateral flange 340 which extends from adjacent a first lateral edge of the major surface 332 of the envelope along a lateral surface 336 of the envelope and a second lateral flange 341 which extends from adjacent a second lateral edge of the major surface 334 of the envelope along the second major surface of the envelope. The lateral flanges 340 and 341 extend for at least the length of the insulation batt 22 within the envelope. The lateral surface 336, adjacent the first lateral flange 340, has a pressure sensitive adhesive 342 thereon for securing the lateral surface 336 to a frame member and the second major surface 334, adjacent the second lateral flange 341, has a pressure sensitive adhesive 342 thereon for securing a lateral portion of the second major surface 334, adjacent the second lateral edge of the major surface, to a frame member. The pressure sensitive adhesive 342 may be applied to the lateral surface 336 and the second major surface 334 of the envelope as a double stick tape coated with the pressure sensitive adhesive, a sprayed web of the pressure sensitive adhesive, dots of the pressure sensitive adhesive, beads of the pressure sensitive adhesive, or a coating of the pressure sensitive adhesive applied by other conventional methods. The areas covered by the pressure sensitive adhesive on the lateral surface 336 and the second major surface 334 of the envelope, which are typically about ¾ of an inch to about 1 inch in width and extend for the length of the envelope, need not be completely covered with the pressure sensitive adhesive 342 and, preferably, the pressure sensitive adhesive 342 only covers from about 20% to about 50% of these surface areas. The pressure sensitive adhesive 342 is the same as that described in connection with the first embodiment 20 of the encapsulated insulation batt assembly and may be applied to the surface areas on the lateral surface 336 of the envelope and the second major surface 334 of the envelope in the same manner as shown in the examples of FIGS. 11 to 14.

The lateral flanges 340 and 341 of the envelope 324 each have first and second sides. The second sides of the lateral flanges 340 and 341 are coated with a release agent 344 and function as release liners for the pressure sensitive adhesive 342 on the lateral surface 336 and the second major surface 334 of the envelope by overlaying and being releasably secured to the pressure sensitive adhesive 342 on these contact areas of the envelope. The lateral flange 340 of the envelope 324 can be folded from a first position where the lateral flange 340 extends from adjacent the first lateral edge of the major surface 332 of the envelope generally parallel to and in contact with the pressure sensitive adhesive 342 on the lateral surface 336 of the envelope for pre-installation handling of the encapsulated insulation batt assembly to a second position where the lateral flange 340 extends outward, away from the lateral surface of the envelope 324, to expose the pressure sensitive adhesive on the lateral surface of the envelope for installation of the encapsulated insulation batt assembly 320. The lateral flange 341 of the envelope 324 can be folded from a first position where the lateral flange 341 extends from adjacent the second lateral edge of the second major surface 334 of the envelope generally parallel to and in contact with the pressure sensitive adhesive 342 on the second major surface 334 of the envelope for pre-installation handling of the encapsulated insulation batt assembly to a second position where the lateral flange 341 extends outward, away from the major surface of the envelope 324, to expose the pressure sensitive adhesive on the second major surface of the envelope for installation of the encapsulated insulation batt assembly 320. Prior to the installation of the encapsulated insulation batt assembly 320, the lateral flanges 340 and 341 of the envelope 324 are located in the first position to overlay the pressure sensitive adhesive 342 on the lateral and second major surfaces of the envelope 324. Thus, the lateral flanges 340 and 341 cover the pressure sensitive adhesive 342 prior to installation of the encapsulated insulation batt assembly 320 and are removed from the pressure sensitive adhesive 342 immediately prior to bonding the pressure sensitive adhesive coated envelope portions of the encapsulated insulation batt assembly to the spaced-apart frame members defining the cavity being insulated.

While it is contemplated that separate release liners (e.g. separate sheets or strips of paper coated on one surface with a release agent such as silicone) could be secured to the second surfaces of the lateral flanges 340 and 341 instead of utilizing the release agent coated or treated areas on the second surfaces of the flanges 340 and 341, the use of the coated areas on the second surfaces of the lateral flanges 340 and 341 is preferred because the use of separate release liners would add to material costs.

Figure 10:
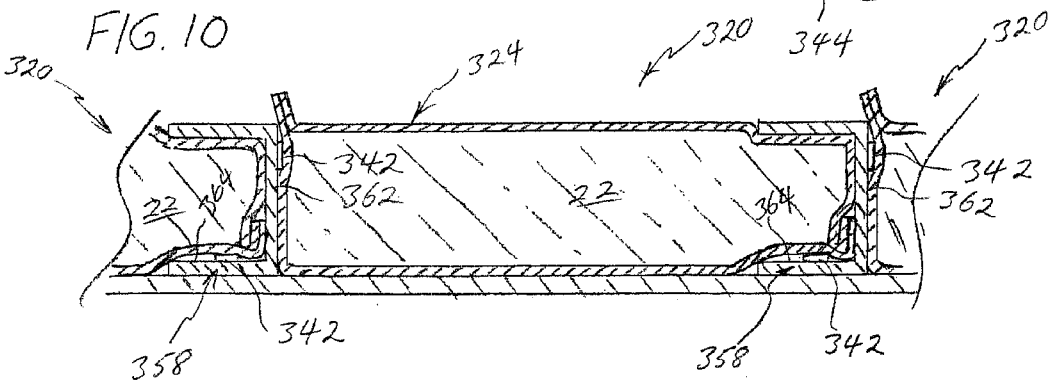
FIG. 10 is a schematic horizontal cross section through a wall illustrating the installation of the encapsulated insulation batt assembly of FIG. 9 in a wall.

As shown in FIG. 10, the encapsulated insulation batt assemblies 320 of the present invention are typically installed between the adjacent or successive spaced-apart channel shaped frame members 358 of a building, such as but not limited to, wall studs, floor and ceiling joists, and rafters. The lateral flanges 340 and 341 of the envelopes 224 are folded back to expose the areas of pressure sensitive adhesive 342 on the lateral surface 336 and the second major surface 334 of the envelope and the contact areas of pressure sensitive adhesive 342 on the lateral surface 336 and the second major surface 334 are bonded to the exposed surfaces 362 and 364 of the frame members 358 by the pressure sensitive adhesive 342 before the drywall or other interior wall panels (not shown) are secured to the frame members 358. With this structure, a lateral portion of each of the encapsulated insulation assemblies 320 is received within the channel of a frame member 358 to better insulate the cavities formed by the succeeding frame members.

While the first, second and third embodiments 20, 120 and 220 are shown in their preferred form, it is contemplated that the pressure sensitive adhesive could be applied to the lateral surfaces 36, 136 and 236 of the envelope instead of the lateral flanges 40, 140 and 240, and that the lateral flanges 40, 140 and 240, could be coated or treated with release agents on their second surfaces and used as release liners for the pressure sensitive adhesive on the lateral surfaces of these embodiments.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. An encapsulated insulation batt assembly, comprising:

a fibrous insulation batt having a width, a length and a thickness; first and second major surfaces of the insulation batt being defined by the width and the length of the insulation batt; lateral surfaces of the insulation batt being defined by the length and the thickness of the insulation batt; and end surfaces of the insulation batt being defined by the width and the thickness of the insulation batt; and an envelope containing the insulation batt having first and second major surfaces and lateral surfaces overlaying the first and second major surfaces and the lateral surfaces of the insulation batt; the envelope having lateral flanges, extending from a midportion of the lateral surfaces of the envelope intermediate lateral edges of the first and second major surfaces of the envelope and for the length of the insulation batt, which can be extended outward from the lateral surfaces of the envelope for securing the encapsulated insulation batt assembly to spaced-apart frame members defining a cavity to be insulated; the lateral flanges each having first and second sides; the second side of each of the lateral flanges having a pressure sensitive adhesive thereon for securing the lateral flanges to spaced-apart frame members defining a cavity to be insulated; and a release liner for the pressure sensitive adhesive on each of the lateral flanges overlaying and releasably secured to the pressure sensitive adhesive on the lateral flange for covering the pressure sensitive adhesive prior to installation of the encapsulated insulation batt assembly and removal from the pressure sensitive adhesive immediately prior to bonding the lateral flanges of the encapsulated insulation batt assembly to spaced-apart frame members defining a cavity to be insulated.

2. The encapsulated insulation batt assembly according to claim 1, wherein:

the width of the insulation batt is substantially equal to a width of a cavity to be insulated by the encapsulated insulation batt assembly.

3. The encapsulated insulation batt assembly according to claim 1, wherein:

the release liner for the pressure sensitive adhesive on each of the lateral flanges of the envelope is a contact area on one of the lateral surfaces of the envelope treated with a release agent; each of the lateral flanges of the envelope can be folded from a first position where the lateral flanges extend generally parallel to the lateral surfaces of the envelope for pre-installation handling of the encapsulated insulation batt assembly to a second position where the lateral flanges extend outward away from the lateral surfaces of the envelope for installation of the encapsulated insulation batt assembly; and, prior to installation of the encapsulated insulation batt assembly, the lateral flanges of the envelope are located in the first position with the pressure sensitive adhesive on the second surface of each of the lateral flanges in contact with and releasably bonded to the contact area of one of the lateral surfaces of the envelope.

4. The encapsulated insulation batt assembly according to claim 3, wherein:

the pressure sensitive adhesive on the second surface of each lateral flange is a tape coated with the pressure sensitive adhesive; and one side of the tape is bonded to the second surface of the lateral flange.

5. The encapsulated insulation batt assembly according to claim 4, wherein:

there is a continuous strip of the pressure sensitive adhesive on the second surface of each of the lateral flanges.

6. The encapsulated insulation batt assembly according to claim 4, wherein:

there is a discontinuous strip of pressure sensitive adhesive on the second surface of each of the lateral flanges.

7. The encapsulated insulation batt assembly according to claim 4, wherein:

the pressure sensitive adhesive on the second surface of each of the lateral flanges is discontinuous and covers about 20% to about 50% of the second surface of each of the flanges.

8. The encapsulated insulation batt assembly according to claim 3, wherein:

the pressure sensitive adhesive on the second surface of each lateral flange is a pressure sensitive adhesive coating applied to the second surface of each of the flanges.

9. The encapsulated insulation batt assembly according to claim 8, wherein:

there is a continuous strip of the pressure sensitive adhesive on the second surface of each of the lateral flanges.

10. The encapsulated insulation batt assembly according to claim 8, wherein:

there is a discontinuous strip of the pressure sensitive adhesive on the second surface of each of the lateral flanges.

11. The encapsulated insulation batt assembly according to claim 8, wherein:

the pressure sensitive adhesive on the second surface of each of the lateral flanges is discontinuous and covers about 20% to about 50% of the second surface of each of the lateral flanges.

12. The encapsulated insulation batt assembly according to claim 3, wherein:

the pressure sensitive adhesive on the second surface of each lateral flange is a series of dots of the pressure sensitive adhesive which covers about 20% to about 50% of the second surface of each of the lateral flanges.

13. The encapsulated insulation batt assembly according to claim 3, wherein:

the pressure sensitive adhesive on the second surface of each lateral flange is a bead of the pressure sensitive adhesive extending for substantially a length of the flanges.

14. The encapsulated insulation batt assembly according to claim 1, wherein:

the envelope is a polymeric film envelope.

15. An encapsulated insulation batt assembly, comprising:

a fibrous insulation batt having a width, a length and a thickness; first and second major surfaces of the insulation batt being defined by the width and the length of the insulation batt; first and second lateral surfaces of the insulation batt being defined by the length and the thickness of the insulation batt; and end surfaces of the insulation batt being defined by the width and the thickness of the insulation batt; and an envelope containing the insulation batt having first and second major surfaces and first and second lateral surfaces overlaying the first and second major surfaces and the first and second lateral surfaces of the insulation batt; the envelope having first and second lateral flanges, extending for the length of the insulation batt, which can be extended outward from the envelope for securing the encapsulated insulation batt assembly to spaced-apart frame members defining a cavity to be insulated; the first lateral flange extending from the envelope at a location adjacent a first lateral edge of the first major surface of the envelope; the second lateral flange extending toward a second lateral edge of the first major surface of the envelope from a location adjacent but spaced inwardly from the second lateral edge of the first major surface of the envelope; the first and second lateral flanges each having first and second sides; the second side of each of the lateral flanges having a pressure sensitive adhesive thereon for securing the lateral flanges to spaced-apart frame members defining a cavity to be insulated; and a release liner for the pressure sensitive adhesive on each of the lateral flanges overlaying and releasably secured to the pressure sensitive adhesive on the lateral flange for covering the pressure sensitive adhesive prior to installation of the encapsulated insulation batt assembly and removal from the pressure sensitive adhesive immediately prior to bonding the lateral flanges of the encapsulated insulation batt assembly to spaced-apart frame members defining a cavity to be insulated.

16. The encapsulated insulation batt assembly according to claim 15, wherein:

the width of the insulation batt is substantially equal to a width of a cavity to be insulated by the encapsulated insulation batt assembly.

17. The encapsulated insulation batt assembly according to claim 15, wherein:

the release liner for the pressure sensitive adhesive on each of the lateral flanges of the envelope is a contact area on an adjacent surface of the envelope treated with a release agent; the first lateral flange of the envelope can be folded from a first position where the first lateral flange extends generally parallel to and is in contact with the adjacent release agent treated surface on the first lateral surface of the envelope for pre-installation handling of the encapsulated insulation batt assembly to a second position where the lateral flange extends outward away from the adjacent release agent treated contact area on the surface of the envelope for installation of the encapsulated insulation batt assembly; the second lateral flange of the envelope can be folded from a first position where the second lateral flange extends generally parallel to and is in contact with the adjacent release agent treated surface on the first major surface of the envelope for pre-installation handling of the encapsulated insulation batt assembly to a second position where the lateral flange extends outward away from the adjacent release agent treated contact area on the surface of the envelope for installation of the encapsulated insulation batt assembly; and, prior to installation of the encapsulated insulation batt assembly, the lateral flanges of the envelope are located in the first position with the pressure sensitive adhesive on the second surface of each of the lateral flanges in contact with and releasably bonded to the adjacent release agent treated contact area on the surface of the envelope.

18. The encapsulated insulation batt assembly according to claim 17, wherein:

the pressure sensitive adhesive on the second surface of each lateral flange is a tape coated with the pressure sensitive adhesive; and one side of the tape is bonded to the second surface of the lateral flange.

19. The encapsulated insulation batt assembly according to claim 18, wherein:

there is a continuous strip of the pressure sensitive adhesive on the second surface of each of the lateral flanges.

20. The encapsulated insulation batt assembly according to claim 18, wherein:

there is a discontinuous strip of pressure sensitive adhesive on the second surface of each of the lateral flanges.

21. The encapsulated insulation batt assembly according to claim 18, wherein:

the pressure sensitive adhesive on the second surface of each of the lateral flanges is discontinuous and covers about 20% to about 50% of the second surface of each of the flanges.

22. The encapsulated insulation batt assembly according to claim 17, wherein:

the pressure sensitive adhesive on the second surface of each lateral flange is a pressure sensitive adhesive coating applied to the second surface of each of the flanges.

23. The encapsulated insulation batt assembly according to claim 22, wherein:

there is a continuous strip of the pressure sensitive adhesive on the second surface of each of the lateral flanges.

24. The encapsulated insulation batt assembly according to claim 22, wherein:

there is a discontinuous strip of the pressure sensitive adhesive on the second surface of each of the lateral flanges.

25. The encapsulated insulation batt assembly according to claim 22, wherein:

the pressure sensitive adhesive on the second surface of each of the lateral flanges is discontinuous and covers about 20% to about 50% of the second surface of each of the lateral flanges.

26. The encapsulated insulation batt assembly according to claim 17, wherein:

the pressure sensitive adhesive on the second surface of each lateral flange is a series of dots of the pressure sensitive adhesive which covers about 20% to about 50% of the second surface of each of the lateral flanges.

27. The encapsulated insulation batt assembly according to claim 17, wherein:

the pressure sensitive adhesive on the second surface of each lateral flange is a bead of the pressure sensitive adhesive extending for substantially a length of the flanges.

28. The encapsulated insulation batt assembly according to claim 15, wherein:

the envelope is a polymeric film envelope.

29. The encapsulated insulation batt assembly according to claim 15, wherein:

the first lateral flange extends from the first lateral edge of the first major surface of the envelope.

30. An encapsulated insulation batt assembly, comprising:

a fibrous insulation batt having a width, a length and a thickness; first and second major surfaces of the insulation batt being defined by the width and the length of the insulation batt; first and second lateral surfaces of the insulation batt being defined by the length and the thickness of the insulation batt; and end surfaces of the insulation batt being defined by the width and the thickness of the insulation batt; and an envelope containing the insulation batt having first and second major surfaces and first and second lateral surfaces overlaying the first and second major surfaces and the first and second lateral surfaces of the insulation batt; the envelope having first and second lateral flanges extending for the length of the insulation batt; the first lateral flange extending from the envelope at a location adjacent a juncture of the first lateral surface and a first lateral edge of the first major surface of the envelope; the second lateral flange extending from the envelope at a location adjacent a juncture of the second lateral surface and a second lateral edge of the second major surface of the envelope; the first lateral surface of the envelope having a pressure sensitive adhesive thereon adjacent the first lateral flange for securing the first lateral surface of the envelope to a spaced-apart frame member, the second major surface of the envelope having a pressure sensitive adhesive thereon adjacent the second lateral flange for securing the second major surface of the envelope, adjacent the second edge, to a spaced-apart frame member; the first and second lateral flanges each having first and second sides; the second side of the first lateral flange having a release liner overlaying and releasably secured to the pressure sensitive adhesive on the first lateral surface and the second side of the second lateral flange having a release liner overlaying and releasably secured to the pressure sensitive adhesive on the second major surface for covering the pressure sensitive adhesive on the envelope prior to installation of the encapsulated insulation batt assembly and removal from the pressure sensitive adhesive immediately prior to bonding the lateral flanges of the encapsulated insulation batt assembly to spaced-apart frame members defining a cavity to be insulated.

31. The encapsulated insulation batt assembly according to claim 30, wherein:

the width of the insulation batt is substantially equal to a width of a cavity to be insulated by the encapsulated insulation batt assembly.

32. The encapsulated insulation batt assembly according to claim 30, wherein:

the release liner for the pressure sensitive adhesive on each of the lateral flanges of the envelope is a contact area on an adjacent surface of the envelope treated with a release agent; the first lateral flange of the envelope can be folded from a first position where the first lateral flange extends generally parallel to and is in contact with the adjacent release agent treated surface on the first lateral surface of the envelope for pre-installation handling of the encapsulated insulation batt assembly to a second position where the lateral flange extends outward away from the adjacent release agent treated contact area on the surface of the envelope for installation of the encapsulated insulation batt assembly; the second lateral flange of the envelope can be folded from a first position where the second lateral flange extends generally parallel to and is in contact with the adjacent release agent treated surface on the first major surface of the envelope for pre-installation handling of the encapsulated insulation batt assembly to a second position where the lateral flange extends outward away from the adjacent release agent treated contact area on the surface of the envelope for installation of the encapsulated insulation batt assembly; and, prior to installation of the encapsulated insulation batt assembly, the lateral flanges of the envelope are located in the first position with the pressure sensitive adhesive on the second surface of each of the lateral flanges in contact with and releasably bonded to the adjacent release agent treated contact area on the surface of the envelope.

33. The encapsulated insulation batt assembly according to claim 32, wherein:

the pressure sensitive adhesive on the second surface of each lateral flange is a tape coated with the pressure sensitive adhesive; and one side of the tape is bonded to the second surface of the lateral flange.

34. The encapsulated insulation batt assembly according to claim 33, wherein:

there is a continuous strip of the pressure sensitive adhesive on the second surface of each of the lateral flanges.

35. The encapsulated insulation batt assembly according to claim 33, wherein:

there is a discontinuous strip of pressure sensitive adhesive on the second surface of each of the lateral flanges.

36. The encapsulated insulation batt assembly according to claim 33, wherein:

the pressure sensitive adhesive on the second surface of each of the lateral flanges is discontinuous and covers about 20% to about 50% of the second surface of each of the flanges.

37. The encapsulated insulation batt assembly according to claim 32, wherein:

the pressure sensitive adhesive on the second surface of each lateral flange is a pressure sensitive adhesive coating applied to the second surface of each of the flanges.

38. The encapsulated insulation batt assembly according to claim 37, wherein:

there is a continuous strip of the pressure sensitive adhesive on the second surface of each of the lateral flanges.

39. The encapsulated insulation batt assembly according to claim 37, wherein:

there is a discontinuous strip of the pressure sensitive adhesive on the second surface of each of the lateral flanges.

40. The encapsulated insulation batt assembly according to claim 37, wherein:

the pressure sensitive adhesive on the second surface of each of the lateral flanges is discontinuous and covers about 20% to about 50% of the second surface of each of the lateral flanges.

41. The encapsulated insulation batt assembly according to claim 32, wherein:

the pressure sensitive adhesive on the second surface of each lateral flange is a series of dots of the pressure sensitive adhesive which covers about 20% to about 50% of the second surface of each of the lateral flanges.

42. The encapsulated insulation batt assembly according to claim 32, wherein:

the pressure sensitive adhesive on the second surface of each lateral flange is a bead of the pressure sensitive adhesive extending for substantially a length of the flanges.

43. The encapsulated insulation batt assembly according to claim 30, wherein:

the envelope is a polymeric film envelope.

44. The encapsulated insulation batt assembly according to claim 30, wherein:

the first lateral flange extends from the first lateral edge of the first major surface of the envelope.

* * * * *